United States Patent [19]

Miron

[11] Patent Number: 4,641,868

[45] Date of Patent: Feb. 10, 1987

[54] RECENTERING FOR SHAFTS OF LOCKS AND OTHER MECHANISMS

[75] Inventor: William L. Miron, Northville, Mich.

[73] Assignee: Computerized Security Systems, Inc., Troy, Mich.

[21] Appl. No.: 643,055

[22] Filed: Aug. 22, 1984

[51] Int. Cl.[4] ..... E05C 13/00

[52] U.S. Cl. ..... 292/336.3; 292/DIG. 61; 292/359

[58] Field of Search ..... 292/204, 209, 336.3, 292/347, 144, 150, DIG. 61, 359; 74/516, 518; 267/150

[56] References Cited

U.S. PATENT DOCUMENTS

| | | | |
|---|---|---|---|
| 1,857,684 | 5/1932 | Flynn | 292/DIG. 61 X |
| 1,961,638 | 6/1934 | Marple | 292/DIG. 61 X |
| 3,025,093 | 3/1962 | Millman | 292/204 |
| 3,909,888 | 10/1975 | Funston et al. | 292/204 X |
| 4,042,268 | 8/1977 | Coglan | 292/347 |

*Primary Examiner*—Richard E. Moore

*Attorney, Agent, or Firm*—Reising, Ethington, Barnard, Perry & Milton

[57] ABSTRACT

A recentering device for a shaft is disclosed which includes a return spring means and a recentering spring. The return spring applies a torque which varies directly with the angular displacement of the shaft from the center position over a predetermined range corresponding to the full operating range of the shaft. The recentering spring means applies a torque which varies inversely with the angular displacement of the shaft over the range of displacement. The maximum torque exerted by the recentering spring means is not substantially greater than the maximum torque exerted by the return spring. The torque exerted by each of the springs is a substantially linear function of angular displacement whereby a substantially uniform value of torque tends to return the shaft to its center position and thereby provides accurate recentering when the shaft is released.

14 Claims, 7 Drawing Figures

Fig-3
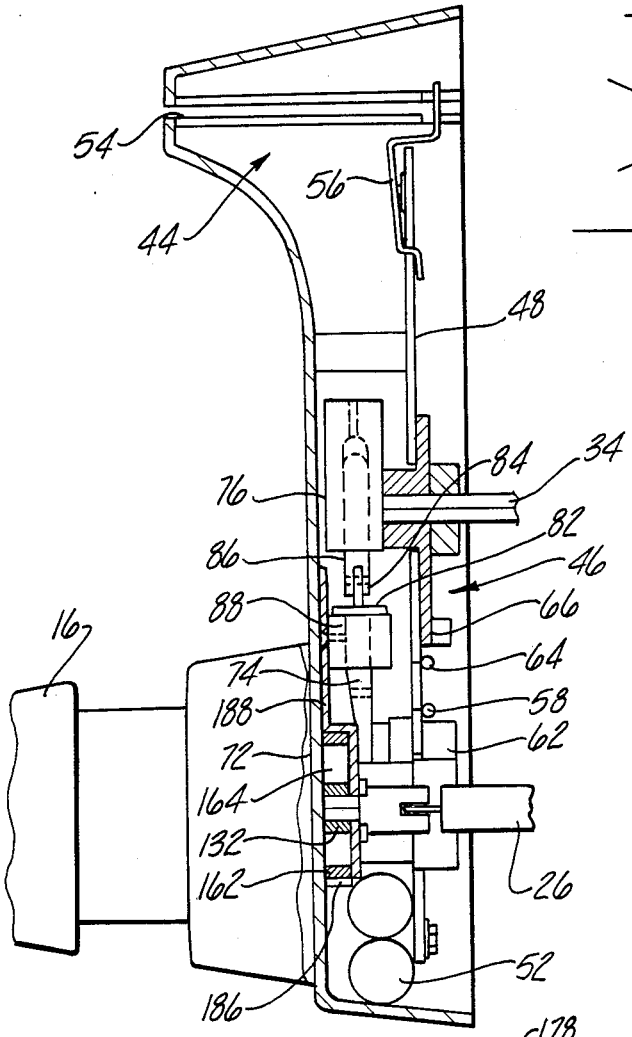
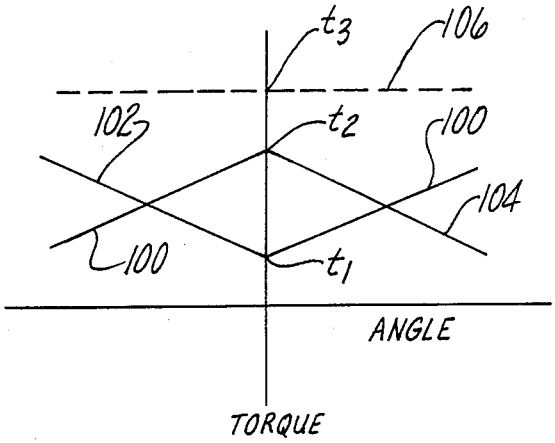
Fig-7
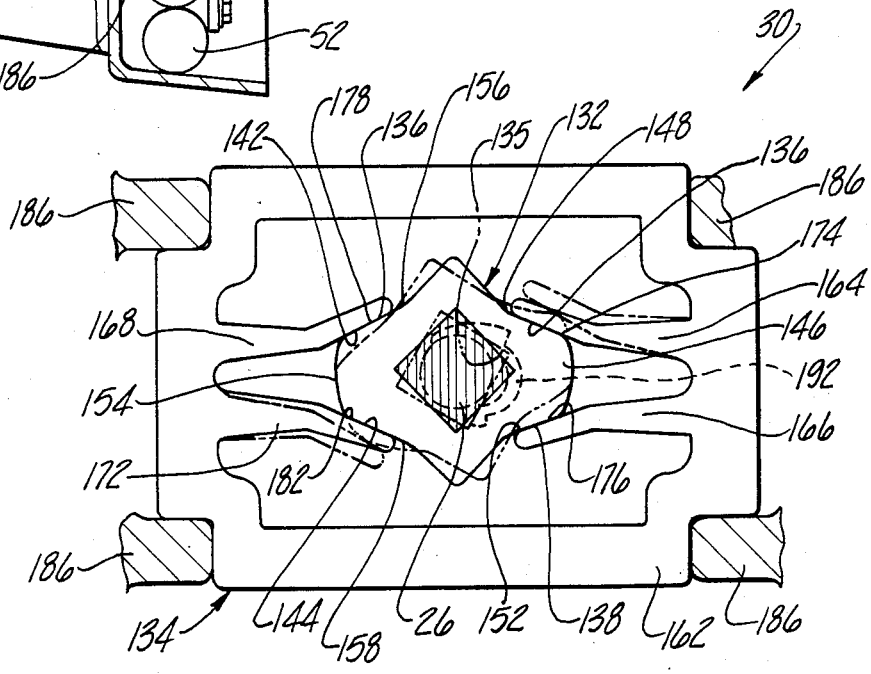
Fig-6

RECENTERING FOR SHAFTS OF LOCKS AND OTHER MECHANISMS

FIELD OF THE INVENTION

This invention relates to a recentering device for shafts; more particulary, it relates to a device which is especially useful for recentering a door lock shaft to assure proper alignment of operating parts.

BACKGROUND OF THE INVENTION

In certain mechanisms, an operating shaft is driven rotatably in one direction, or either direction, from a reference position through a limited angle of displacement and is required to return to the reference position after release of the driving torque. For this purpose, it is a common practice to provide a return spring which is coupled with the shaft in such manner that it is stressed by rotation of the shaft away from the reference position. When the driving torque is removed from the shaft, the stored energy of the return spring drives the shaft toward the reference position. This kind or arrangement is commonly employed in door locks for returning the shaft of the door handle to its centered position. This invention was made to address a particular problem which occurs in operation of return spring arrangements in door locks and will be described with reference thereto as the illustrative embodiment of the invention. The problem in door locks which is solved by this invention may be found in other mechanisms where it is required to return the shaft to its reference position after the turning torque is removed.

The terms "center position" and "reference position" are used synonymously to mean that position of a shaft from which it is rotated and to which it is returned in a cycle of operation, whether it is rotated in only one direction or in either direction from such position.

In door lock mechanisms, the operating shaft carries a cam which actuates a slide and lever for retracting the bolt when the operating shaft is turned in either direction. A return spring is typically used to bias the slide or lever toward the position in which the bolt is extended. The return spring may be somewhat prestressed with the shaft in its center position and the return force which acts to bias the shaft toward its reference position is at its minimum value with the shaft in the center position and is at its maximum value when the shaft is turned to its limiting position in either direction. Because the return bias force diminishes as the reference position is approached, the shaft may not be fully returned to its center position because of friction or gravity loading in opposition to the return bias force. This condition is aggravated after many cycles of operation which results in some loss of resiliency in the return spring. Although the lock operation may not be significantly impaired, there is a possibility in some lock mechanisms that the return bias force may not be effective to return the mechanism to a position which allows the bolt to be fully extended. Further, in locks with a lever handle, the failure of the return spring to return the shaft to the center position is undesirably noticeable in that the lever handle droops from its normal horizonal position.

In electronically controlled locks, the failure of the return spring to return the shaft to the center position can be much more serious, even to the extent of loss of security. In certain electronically controlled locks, the operating shaft is prevented from turning by a solenoid actuated lock pin which enters a lock pin receiver mounted on the shaft when the shaft is in its center position and the solenoid is deenergized. In this kind of system, the door is locked with the lock pin extending into the lock pin receiver. It is unlocked in response to a key bearing the correct code which causes the electronic control system to energize the solenoid and retract the lock pin from the lock pin receiver. After the door is unlocked and opened by turning the handle, the solenoid is deenergized, allowing the lock pin to drop against the receiver. If the operating shaft is returned to the center position, the lock pin will enter the receiver and the door is relocked. If the operating shaft does not return to the center position upon release of the handle, the lock pin will be misaligned with the receiver and the lock pin will not enter the receiver and the door will remain unlocked.

In door locks and other such mechanisms, the problem of the return spring cannot be solved by simply using a stronger spring because there is a practical limit to the amount of turning force which should be required to operate the door lock. Since the return bias force provided by the return spring increases with angular displacement of the operating shaft, the maximum permissible torque places a limit on the strength or spring rate of the return spring to be used. Thus, the problem is that of providing the operating shaft with a return bias torque which is great enough to ensure that the shaft is returned to its center position and yet the operating torque for turning the shaft to its fully operative position must not exceed a predetermined maximum.

A patent search conducted prior to filing of this application did not reveal any prior art which addresses the aforesaid problem. No prior art is known to applicant which is pertinent to the invention set forth hereinbelow.

A general object of this invention is to provide a recentering means for an operating shaft which will ensure that the shaft is returned to its reference or center position without requiring a turning torque greater than a predetermined maximum value.

SUMMARY OF THE INVENTION

In accordance with this invention, a recentering device for a movable member is provided in which a first return bias means applies a force which varies directly with the displacement of the member from a reference position over a predetermined range of displacement corresponding to the full operating range of the member and a second return bias means applies a force which varies inversely with the displacement of the member over said predetermined range of displacement. The member may be movable in rotation or in translation.

Further, in accordance with this invention, a recentering device is provided for use in a lock mechanism of the type comprising a bolt, an operating shaft and means for coupling the shaft to the bolt for actuation thereof by rotation of the shaft from a center position. A return spring is operatively coupled with the shaft for applying a torque which varies directly with the angular displacement of the shaft from the center position over a predetermined range of displacement corresponding to the full operating range of the shaft. A recentering spring is operatively coupled with the shaft for applying a torque which varies inversely with the angular displacement of the shaft over the predetermined range of displacement.

Further, in accordance with this invention, the maximum torque exerted on the shaft by the recentering spring is not substantially greater than the maximum torque exerted by the return spring. The torque exerted by each of the springs is desirably a substantially linear function of angular displacement.

Further, in accordance with this invention, the recentering spring comprises a cam mounted on the shaft for rotation therewith and a resilient member engageable by the cam. Further, the resilient member comprises a spring finger having its free end engageable by the cam.

Further, in accordance with this invention, the cam is substantially rectangular in cross-section with a cam surface on each side thereof. The resilient member includes two pairs of spring fingers with the fingers of each pair extending generally parallel to each other and the two pairs being disposed opposite each other with the free ends of the fingers being spaced apart. The free ends of the first pair of fingers extend toward engagement with the cam surfaces on adjacent sides of the cam and the free ends of the fingers of the second pair extend toward engagement with the cam surfaces on the other adjacent sides of the cam. One spring finger of each pair is deflected by one cam surface upon rotation of the shaft in one direction and the other spring finger of each pair is deflected by cam surface upon rotation of the shaft in the other direction. Preferably, the spring device comprises a unitary body of molded plastic. The free end of each spring finger has a surface extending substantially parallel with the corresponding cam surface and each spring finger is preloaded so that there is a surface-to-surface contact between the spring finger and the cam surface.

A more complete understanding of this invention may be obtained from the detailed description that follows taken with the accompanying drawings.

DESCRIPTION OF THE DRAWINGS

FIG. 3 is a cross-sectional view taken on line 3—3 of FIG. 1;

FIG. 6 shows a recentering spring in accordance with this invention;

FIG. 7 is a graph useful for explanation of this invention.

BEST MODE FOR CARRYING OUT THE INVENTION

Figure 1:
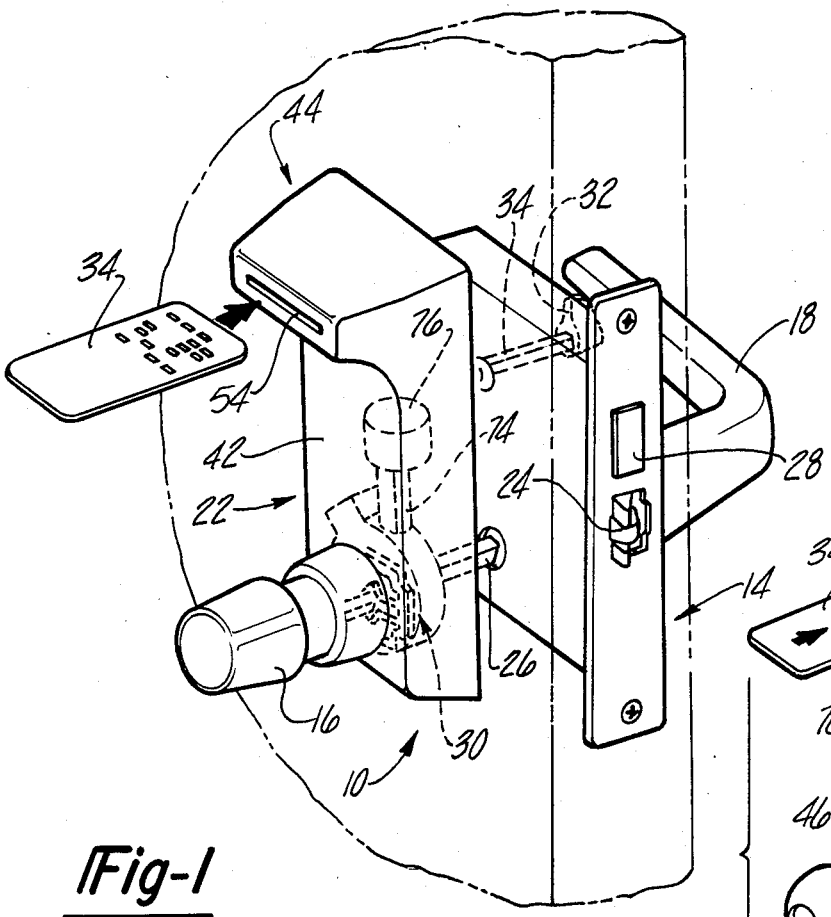
FIG. 1 is a perspective view of a typical door lock installation in which the invention is embodied.

Referring now to the drawings, there is shown an illustrative embodiment of the invention in a door lock; more particularly, an electronically controlled door lock of the type now being used in hotels. It will be appreciated as the description proceeds that the invention is useful in mechanisms other than door locks and that the invention may be utilized in different embodiments.

FIG. 1 shows a door lock in which the recentering device of this invention is incorporated. The door lock 10 is installed on a door 12 and comprises, in general, a conventional mortise lock 14 installed in the door, an outside door knob 16, an inside lever or door handle 18, and a lock control system 22. The lock is provided with a conventional retractable bolt 24 which is operable by the door knob shaft 26 which may be actuated directly by the inside door handle 18 or may be operated through the lock control system 22 by the outside door knob 16. The lock also includes a dead bolt 28 which is actuable by a dead bolt handle 32 on the inside of the door through the dead bolt shaft 34. Also, as provided in the conventional lock 14, the dead bolt 28 is retracted concurrently with the retraction of the bolt 24 by actuation of the inside door handle 18. A key 34 in the form of a punch card, is provided with the lock control system 22 for initiating the manual control of the lock, as will be described subsequently.

Figure 2:
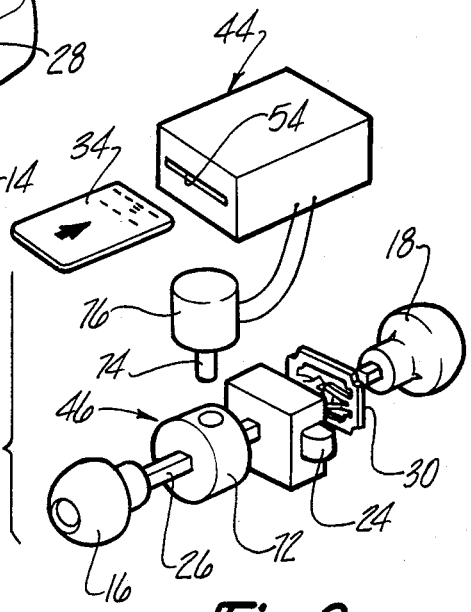
FIG. 2 is an exploded view of a door lock assembly showing the recentering device of the invention.
Figure 4:
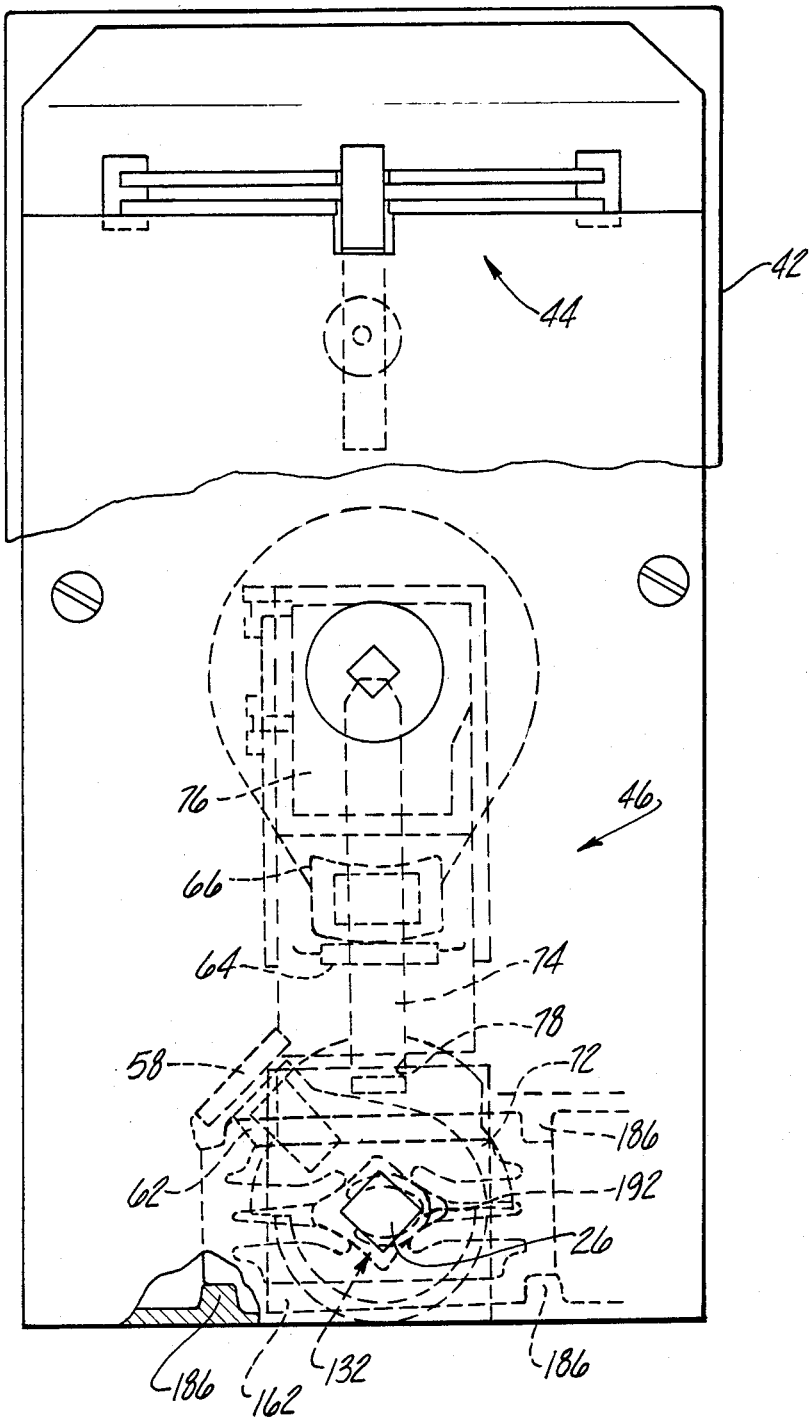
FIG. 4 is an elevation view taken on line 4—4 of FIG. 3.

The lock control system 22 is shown in greater detail in FIGS. 2, 3 and 4. In general, it comprises a lock body 42 which houses a key reader 44, a lock control mechanism 46 and a microcomputer circuit board 48. A pair of batteries 52 are installed in the body 42 for energizing the lock control system.

The key reader 44 includes a slot 54 adapted to receive the key 34. The key reader 44 is an optical reader adapted to detect the presense or absence of punched holes in the key 34. The output of the key reader 44 is supplied as an input to the microcomputer circuit board 48. Other inputs in the circuit board 48 include a key switch 56 which is actuated by the key 34 upon full insertion and upon withdrawal of the key. A door knob detector comprises a reed switch 58 and a switch actuator 62 adapted to produce a signal when the door knob is turned. Another input to the control circuit is provided by a dead bolt detector which comprises a reed switch 64 and a switch actuator 66 movable with the dead bolt shaft 34. The card reader 44 and the control circuit on the microcomputer circuit board 48 may be of a known type such as that disclosed in the Ayden U.S. Pat. No. 4,177,657 and will not be described further herein.

The lock control mechanism 46 comprises a lock pin receiver 72, a reciprocable lock pin 74 and a solenoid 76 for actuating the lock pin. The lock pin receiver 72 is a disk-like member nonrotatably mounted on the lock operating shaft 26. The upper half of the lock pin receiver 72, as viewed in FIG. 4, is of enlarged radius and is provided with a cylindrical recess 78 in alignment with the lock pin 74 when the operating shaft 26 is in its reference or central position. The lock pin 74 is cylindrical with a head 82 at the upper end and is connected by a pivot coupling 84 with the armature 86 of the solenoid 76. The lock pin 74 extends through a guide bracket 88 which is mounted on the lock body and the head 82 of the lock pin rests on the bracket when the lock pin is extended, i.e. dropped by the solenoid. When the lock pin 74 is dropped and is extended into the recess 78, the operating shaft 26 cannot be turned by the door knob 16. Hence, the bolt 24 cannot be retracted and the door is locked. When a key 34 is inserted into the key reader 44 and bears the opening code for the lock 10, the control circuit on the microcomputer circuit board 48 energizes the solenoid 76 and the lock pin 74 is retracted from the lock pin receiver 72. Thus, the operating shaft 26 can be rotated by the door knob 16 and the door is unlocked so that the bolt 24 can be retracted by turning the door knob. After the door knob is turned to open the door and released, the control circuit deenergizes the solenoid 76 so that the armature 86 and the lock pin 74 drop under the influence of gravity. If the operating shaft 26 has returned to its central position by the time the lock pin 74 reaches the upper arcuate surface of the lock pin receiver 72, the lock pin will enter the recess 78 to relock the door. If, on the other hand, the lock pin 74 reaches the arcuate surface of the receiver 72 before the operating shaft 26 has returned to its center position, the lock pin will ride on the arcuate surface and enter the cylindrical recess 78 when the center position is reached. However, if the return mechanism for the operating shaft 26 fails to return it to the center position, the lock pin 74 will be misaligned with the recess 78 and will ride on the arcuate surface of the lock pin receiver. This will leave the door unlocked when it should be locked. Accordingly, it is imperative for proper lock operation to provide means which will ensure that the operating shaft is accurately recentered after the door knob is released.

Figure 5:
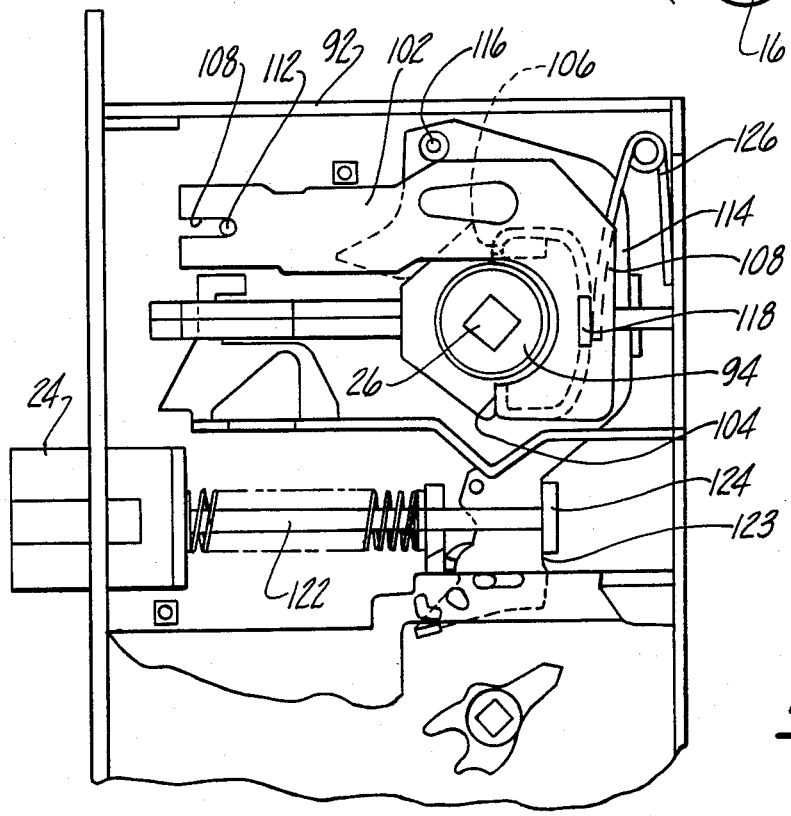
FIG. 5 shows certain details of a mortise lock.

Before describing the recentering device of this invention, it will be helpful to consider that portion of the mechanism in the mortise lock 14 which is conventionally used for returning the operating shaft to its center position. As shown in FIG. 5, the operating shaft 26, which is rectangular in cross-section, extends through a square hole in a bolt actuating cam 94 and is in driving engagement therewith. The cam 94 is rotatably mounted in the lock housing 92 and has cam shoulders 96 and 98 at opposite sides of the shaft for actuation of a slide plate 102. For this purpose, the slide plate is provided with a pair of arms 104 and 106 extending transversely of the plate 102 adjacent the cam shoulders 96 and 98, respectively, for engagement thereby. The slide plate 102 is mounted for reciprocation in the direction of a guide slot 108 which receives a fixed guide pin 112 in the end of the slide plate 102. The slide plate 102 is drivingly connected with a lever 114 which is pivotally mounted by a pivot pin 116 on the lock housing 92. The driving connection between the slide plate 102 and the lever 114 comprises a post 118 extending transversely from the lever 114 into a slot in the slide plate 102. The lever 114 actuates a spring loaded bolt plunger 122 to retract the bolt 24. For this purpose, the end of the lever 114 has a cam shoulder 123 engageable with a head 124 on the plunger 122. The lever 114 is biased by a coil spring which is herein called the return spring 126. The return spring 126 has one free end bearing against the lock housing 92 and the other free end bearing against the arm of the lever 114. The return spring 126 is prestressed so that it exerts a bias force on the lever 114 tending to oppose the retraction of the bolt plunger 122. This bias force on the lever 114 by the return spring 126 also biases the slide plate in a direction such that the arms 104 and 106 engage the cam shoulders 96 and 98, respectively. When the door knob is turned to rotate the operating shaft 26 in a clockwise direction, as viewed in FIG. 5, the cam shoulder 98 which engages the arm 106 on the slide plate 102 drives the slide plate to the right which pivots the lever 114 in a counterclockwise direction against the resistance of the return spring 126 and retracts the bolt 24. Similarly, when the operating shaft 26 is rotated in a counterclockwise direction, the cam shoulder 96 which engages the arm 104 drives the slide plate to the right against the resistance of the return spring 126 and retracts the bolt 24. In either case, when the door handle is released, the return spring 126, by reason of the stored energy therein, drives the lever 114 in a clockwise direction, thus allowing the bolt plunger 122 to extend and applying a torque to the operating shaft 22 toward its center position by reason of the engagement of the arm 104 with the cam shoulder 96 or the engagement of the arm 106 with the cam shoulder 98, as the case may be. Thus, the return spring functions, when the knob is released, to return the operating shaft 26 toward its center position.

The return spring 126 is prestressed with the shaft in the center position and the stress increases as the shaft is rotated in either direction from the center position. Thus, the return bias torque exerted by the return spring on the operating shaft 26 increases directly with angular displacement of the shaft. This return bias torque is at a minimum value with the shaft in its center position and is at its maximum value when the shaft is fully turned to its limiting position for opening the door. The return spring 126 is designed so that the maximum return bias torque does not exceed a predetermined value which will maximize the return bias torque without requiring an excessive manual torque to operate the door lock. However, the return bias torque provided by the return spring 126 with the operating shaft 26 in the vicinity of the center position is of low value and is inadequate to ensure that friction and gravity will be overcome to return the operating shaft accurately to the center position.

In order to ensure that the operating shaft 26 is accurately recentered upon release of the door knob 16, the recentering spring means 30 is provided. The recentering spring means 30 will now be described with reference to FIGS. 3, 4 and 6. As shown in FIG. 6, the recentering spring means 30 comprises, in general, a cam 132 and a spring device 134. The cam 132 has a rectangular opening 135 which receives the square operating shaft 26 and is movable therewith. The cam 132 has an overall configuration which is substantially rectangular in cross-section transversely of the shaft; it is provided with a first pair of cam surfaces 146 and 138 and a second pair of cam surfaces 142 and 144. The cam surface 136 is a substantially flat ramp extending from a first rounded corner 136 to a shoulder 148. Similarly, the cam surface 138 is a substantially flat ramp extending from the rounded corner 146 to a shoulder 152. The cam surfaces 142 and 144 are of the same construction with ramp surfaces extending from a second rounded corner 154 to shoulders 156 and 158, respectively.

The spring device 134 comprises a generally rectangular support frame 162, a first pair of spring fingers 164 and 166 and a second pair of spring fingers 168 and 172. The support frame 162 is provided with a notch at each corner for mounting purposes, as will be described presently. The spring fingers 164 and 166 extend inwardly as cantilevers from one side of the frame 162 and are generally parallel to each other. The free end of the spring finger 164 has a cam follower surface 174 which is substantially coextensive with and parallel to the cam surface 136 with the spring finger 164 slightly prestressed by outward deflection. Similarly, the spring finger 166 is provided at its free end with a cam follower surface 176 which is substantially coextensive with and parallel to the cam surface 138 when the spring finger 166 is slightly prestressed by outward deflection. Spring fingers 168 and 172 extend from the opposite sides of the support frame 162 and are of the same construction as spring fingers 164 and 166. The spring device 134 is a unitary body of molded plastic, suitably an acetal copolymer which has a high degree of resilience and hardness with a low friction surface.

The spring device 134 is mounted in the lock body 42 as shown in FIGS. 3 and 4. The lock body is provided with a set of four retaining lugs 186 which are formed on the inner surface thereof. The notches in the corners of the support frame 162 are aligned with and receive the respective lugs 186 which hold the frame against movement in the plane of the frame. The support frame 162 is held in place on the lugs by an internal plate 188 in the lock body 42. The cam 132 is mounted by inserting the operating shaft 126 through it and it is retained axially on the shaft by a snap ring 192.

With the recentering spring means 30 installed as described above, the cam 132 coacts with the spring fingers 164, 166, 168 and 172 as shown in FIG. 6. With the operating shaft 26 in its center position, the cam 132 is engaged by each of the spring fingers. The dimensions of the cam 132 are such that each of the spring fingers is slighly deflected outwardly by the cam and hence is slightly prestressed. The positions of the spring fingers with the operating shaft 26 in its center position is shown by the full lines in FIG. 6. In this condition, there is a surface-to-surface contact between the cam surface 136 and the cam follower surface 174 on finger 164. Similarly, there is surface-to-surface contact between the cam surface 138 and the cam follower surface 176, between the cam surface 142 and the cam follower surface 178, and between the cam surface 144 and the cam follower surface 182.

When the operating shaft 26 is rotated from the center position in either direction, the recentering spring means 30 develops a recentering torque which varies inversely with the angular displacement of the shaft. The relationship of the parts with the shaft rotated away from the center position in a counterclockwise direction is shown in phantom lines in FIG. 6. In this position, the spring fingers 164 and 172 are deflected outwardly from the axis of the shaft whereas the spring fingers 166 and 168 remain substantially undeflected. The rotation of the shaft 26, as shown, causes the rounded corner 146 of the cam 132 to engage the cam surface 136 at a contact line (as distinguished from the surface contact when the cam is in the center position). It is noted that progressive rotation of the operating shaft 26 causes the line contact between the rounded corner 146 of the cam and the cam surface 136 to move progressively toward the free end of the spring finger 164. As a result, the force applied by the cam 132 to the spring finger 164 tending to deflect it acts over a progressively increasing lever arm length as the angular displacement of the shaft increases. Accordingly, the torque on the shaft 26 required to deflect the spring finger 164 is at its maximum value with the shaft in its center position and it decreases in a substantially linear fashion over a range corresponding to the full angular excursion of the shaft. During this counterclockwise rotation of the shaft 26, the spring finger 172 coacts with the cam surface 144 in the same manner as just described with reference to spring finger 164 and cam surface 136. Also, during this counterclockwise rotation of the shaft 26, the spring fingers 166 and 168 remain substantially undeflected since the respective cam surfaces 138 and 142 do not move toward the cam follower surfaces 176 and 178. It will now be understood that the operation of the recentering spring means 30 upon rotation of the operating shaft 26 in a clockwise direction is the same as that just described for counterclockwise rotation. In summary, clockwise rotation of the operating shaft causes cam surfaces 138 and 142 to engage the cam follower surfaces 176 and 178, respectively, and deflect them progressively with increased rotation of the shaft. During this clockwise rotation of the shaft, the spring fingers 164 and 172 remain undeflected since the respective cam surfaces 136 and 144 do not engage the cam follower surfaces 174 and 182.

As described above, a restraining torque on the operating shaft 26 developed by the recentering spring means 30 for either direction of rotation from its center position varies inversely with angular displacement in a substantially linear fashion. By the same token, the restoring torque exerted by the recentering spring means 30 on the operating shaft 26 tending to recenter it also varies as a inverse function of angular displacement from the center position in a substantially linear manner.

The operation of the recentering device of this invention is further illustrated in the graph of FIG. 7 which shows an approximate relationship of torque values for the purpose of explanation. As described above, the return spring 126 exerts a return bias torque on the operating shaft 26 which varies directly with angular displacement of the shaft from its center position. This variation ranges from a torque value t1 at the center position, corresponding to the prestressing of the return spring 26, to a maximum value t2 which is the torque developed when the shaft is turned to its limiting position for retracting the bolt. This relationship, torque as a function of displacement angle, is illustrated by the graph line 100 for clockwise rotation and graph line 102 for counterclockwise rotation. Also, as described above, the recentering spring means 30 exerts a recentering torque on the operating shaft 26 which varies inversely with angular displacement of the shaft from its center position. The torque exerted by the recentering spring has a maximum value of t2 at the center position and has a minimum value of t1 when the shaft is rotated to its limiting position. This is shown by graph line 104 for clockwise rotation and by graph line 106 for counterclockwise rotation. Accordingly, the bias torque tending to restore the operating shaft 26 to its center position is the summation of the torques exerted by the return spring 126 and the recentering spring means 30. This summation, shown by dashed line 106 in FIG. 7, is a substantially constant value t3 and thus the torque acting on the shaft is approximately uniform over the full range of displacement of the shaft. Consequently, the torque tending to return the shaft to its center position is at value t3 over the entire excursion, even at an incremental distance away from the center position thus ensuring accurate recentering. At the same time, the torque required to turn the shaft away from the center position never exceeds the value t3, even at the limit of rotation.

Although this invention has described with reference to a particular embodiment, it is not to be construed in a limiting sense. Many variations and modifications will now occur to those skilled in the art. For a definition of the invention reference is made to the appended claims.

What is claimed is:

1. In a lock mechanism of the type comprising a bolt, an operating shaft, means for coupling the shaft to the bolt for actuating the bolt in response to rotation of said shaft from a center position, a return spring operatively coupled with said shaft for applying a return torque thereto toward the center position, said return torque varying directly with angular displacement of the shaft from the center position over a predetermined range of displacement of said shaft, the improvement comprising:

a recentering spring means operatively coupled with said shaft for applying a restoring torque thereto toward the center position, said restoring torque varying inversely with angular displacement of the shaft from the center position over said predetermined range of displacement.

2. The invention as defined in claim 1 wherein the maximum torque exerted on said shaft by said recentering spring means is not substantially greater than the maximum torque exerted on said shaft by said return spring.

3. The invention as defined in claim 2 wherein the torque exerted by said return spring and by said recentering spring means is a substantially linear function of angular displacement of said shaft.

4. The invention as defined in claim 1 wherein said recentering spring means comprises:

a cam mounted on said shaft for rotation therewith, and a stationary device including a resilient member engageable by said cam.

5. The invention as defined in claim 4 wherein said resilient member comprises a spring finger having its free end engageable by said cam upon rotation of said shaft.

6. The invention as defined in claim 1 wherein said recentering spring means comprises:

a cam mounted on said shaft for rotation therewith and having a pair of cam surfaces extending divergently from each other, and a spring device including a pair of spring fingers extending generally to each other and toward engagement with respective ones of said cam surfaces whereby one spring finger is deflected by one cam surface upon rotation of said shaft in one direction and the other spring finger is deflected by the other cam surface upon rotation of said shaft in the other direction.

7. The invention as defined in claim 6 wherein:

said cam is substantially rectangular in cross-section, said spring device includes two pairs of spring fingers, the fingers of each pair extending generally parallel to each other, the two pairs being disposed opposite each other with the free ends of said fingers being spaced apart, the free ends of the first pair of fingers extending toward engagement with adjacent sides of said cam, respectively, and the free ends of the fingers of the second pair extending toward engagement with adjacent sides of said cam, respectively, whereby one spring finger of each pair is deflected by one cam surface upon rotation of said shaft in one direction and whereby the other spring finger of each pair is deflected by the other cam surfaces upon rotation of said shaft in the other direction.

8. The invention as defined in claim 7 wherein said spring device comprises a unitary body of molded plastic.

9. The invention as defined in claim 7 wherein, the free end of each spring finger has a surface extending substantially parallel with the corresponding cam surface on said cam, each of said spring fingers being preloaded so that there is surface-to-surface contact between each spring finger and said cam surface.

10. In a lock mechanism of the type comprising:

a bolt, an operating shaft, means for coupling the shaft to the bolt for actuating the bolt in response to rotation of said shaft from a center position, a lock pin receiver mounted on said shaft and rotatable therewith, a solenoid actuated lock pin in alignment with said lock pin receiver when said shaft is in said center position, a return spring operatively coupled with said shaft for applying a return torque thereto toward said center position, said return torque varying directly with angular displacement of the shaft from said center position over a predetermined range of displacement corresponding to the full operating range of said shaft, a recentering spring means operatively coupled with said shaft for applying a restoring torque thereto toward said center position, said restoring torque varying inversely with angular displacement of the shaft from said center position over said predetermined range of displacement.

11. A recentering device for a movable member comprising:

a movable member, a first means for applying a first return force to said member toward a reference position, said first return force varying directly with the displacement of the member from the reference position over a predetermined range of displacement corresponding to the full operating range of said member, and a second means for applying a second return force to said member toward the reference position, said second return force varying inversely with the displacement of the member from the reference position over said predetermined range of displacement.

12. The invention as defined in claim 11 wherein said movable member is a rotatable shaft.

13. The invention as defined in claim 12 wherein the maximum force exerted on said shaft by said second means is not substantially greater than the maximum force exerted on said shaft by said first means.

14. The invention as defined in claim 13 wherein the force exerted by each of said means is a substantially linear function of angular displacement of said shaft.

* * * * *

UNITED STATES PATENT AND TRADEMARK OFFICE

CERTIFICATE OF CORRECTION

PATENT NO. : 4,641,868

DATED : February 10, 1987

INVENTOR(S) : William L. Miron

It is certified that error appears in the above-identified patent and that said Letters Patent is hereby corrected as shown below:

IN THE ABSTRACT:

Line 2, delete "means" and after "recentering spring" insert -- means --.

IN THE SPECIFICATION:

Column 6, line 38, delete "146" and insert -- 136 --.

Line 40, delete "136" and insert -- 146 --.

Column 7, line 18, delete "slighly" and insert -- slightly --.

IN THE CLAIMS:

Column 9, line 34, after "generally" insert -- parallel --.

Signed and Sealed this

Twenty-seventh Day of September, 1988

*Attest:*

DONALD J. QUIGG

*Attesting Officer*

*Commissioner of Patents and Trademarks*